US006567056B1

(12) United States Patent
Waltho

(10) Patent No.: US 6,567,056 B1
(45) Date of Patent: May 20, 2003

(54) HIGH ISOLATION LOW LOSS PRINTED BALUN FEED FOR A CROSS DIPOLE STRUCTURE

(75) Inventor: Alan E. Waltho, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/993,187

(22) Filed: Nov. 13, 2001

(51) Int. Cl.[7] ..... H01Q 21/26

(52) U.S. Cl. ..... 343/797; 343/795; 343/702; 343/700 MS; 343/84

(58) Field of Search ..... 343/700 MS, 702, 343/795, 797, 821, 846, 848, 872

(56) References Cited

U.S. PATENT DOCUMENTS 4,686,536 A * 8/1987 Allcock ..... 343/700 MS
5,280,286 A * 1/1994 Williamson ..... 342/364
5,677,698 A * 10/1997 Snowdon ..... 343/702
5,874,924 A * 2/1999 Csongor et al. ..... 343/789
5,936,587 A * 8/1999 Gudilev et al. ..... 343/702
5,949,383 A * 9/1999 Hayes et al. ..... 333/26
5,966,098 A * 10/1999 Qi et al. ..... 343/702
6,069,590 A * 2/2000 Thompson et al. ..... 343/795
6,034,649 A * 3/2000 Wilson et al. ..... 343/795
6,072,439 A * 6/2000 Ippolito et al. ..... 343/795
6,160,515 A * 12/2000 McCoy et al. ..... 343/702
6,163,306 A * 12/2000 Nakamura et al. ... 343/700 MS
6,337,667 B1 * 1/2002 Ayala et al. ..... 343/702

* cited by examiner

*Primary Examiner*—Tan Ho
(74) *Attorney, Agent, or Firm*—Blakely, Sokoloff, Taylor & Zafman LLP

(57) ABSTRACT

According to one embodiment, a system is disclosed. The system includes a first dipole antenna, a second dipole antenna located orthogonal to the first dipole antenna, and a cross balance/unbalance (balun) feed coupled to the first dipole antenna and the second dipole antenna.

37 Claims, 4 Drawing Sheets

HIGH ISOLATION LOW LOSS PRINTED BALUN FEED FOR A CROSS DIPOLE STRUCTURE

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever.

FIELD OF THE INVENTION

The present invention relates to wireless communication; more particularly, the present invention relates to maintaining isolation of two or more wireless devices in a single platform.

BACKGROUND

Currently, the use of wireless communication devices at computing platforms has become prevalent. Such wireless devices include Bluetooth™ wireless technology developed by the Bluetooth Special Interest Group, and the IEEE 802.11b standard wireless LAN specification. Recently, there has been an interest in integrating two or more wireless devices (e.g., Bluetooth and 802.11b) on the same platform.

However, whenever two or more wireless devices operating at approximately the same frequency are placed on the same platform, a problem occurs. The small size of many host platforms does not permit multiple antennas to be separated by more than a few inches. As a result, the isolation between the wireless devices is generally less than 20 dB, which is insufficient to enable the simultaneous use of multiple devices using the same frequency band without causing interference.

BRIEF DESCRIPTION OF THE DRAWINGS

The present invention will be understood more fully from the detailed description given below and from the accompanying drawings of various embodiments of the invention. The drawings, however, should not be taken to limit the invention to the specific embodiments, but are for explanation and understanding only.

DETAILED DESCRIPTION

A mechanism to isolate a balun feed for a cross dipole structure is described. Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

In the following description, numerous details are set forth. It will be apparent, however, to one skilled in the art, that the present invention may be practiced without these specific details. In other instances, well-known structures and devices are shown in block diagram form, rather than in detail, in order to avoid obscuring the present invention.

Figure 1:
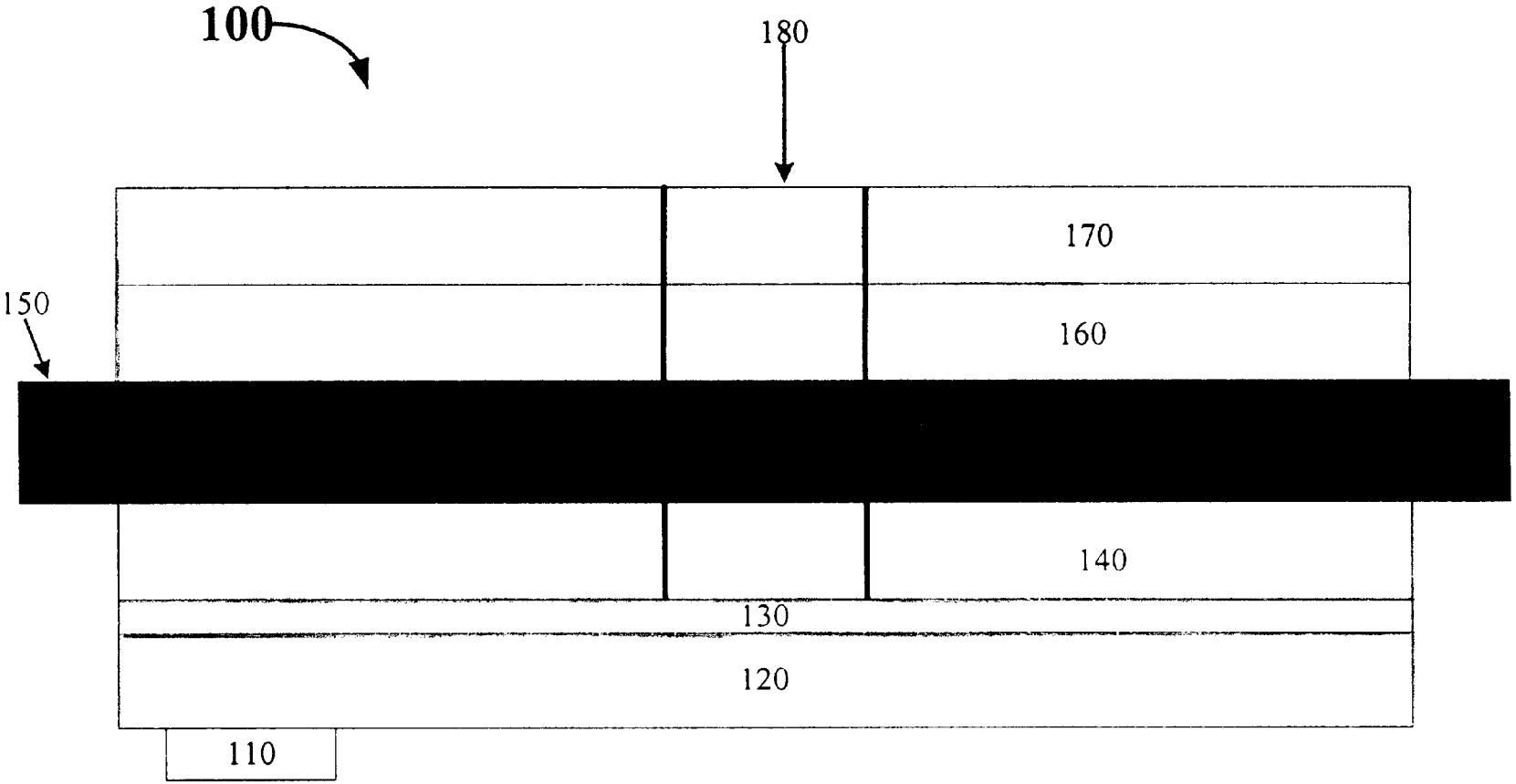
FIG. 1 illustrates one embodiment of a system.

FIG. 1 illustrates one embodiment of a system 100. According to one embodiment, system 100 is a laptop computer. In other embodiments, system 100 may be a personal digital assistant (PDA) assembly. Nevertheless, one of ordinary skill in the art will appreciate that system 100 may be implemented using other types of portable computing, or other electronic assemblies.

Referring to FIG. 1, system 100 includes a radio frequency (RF) connection 110, primary balance/unbalance (balun) layer 120, a dielectric substrate layer 130, secondary balun layer 140, case 150, RF absorbing material (RAM) 160, antenna layer 170 and wire feed through 180. RF connection 110 is a connector that connects one or more RF cables with primary balun layer 120. In one embodiment, RF cables are received from wireless device circuits (not shown) within system 100.

Primary balun layer 120 is a printed circuit layout layer that includes a primary balun circuit. A balun is a type of transformer that is used to convert an unbalanced signal to a balanced signal, or vice versa. In particular, baluns isolate a transmission line and provide a balanced input to antenna layer 170. According to one embodiment, secondary balun layer 140 receives feeds from two wireless radio devices operating within system 100.

The substrate 130 provides electrical isolation between primary balun layer 120 and secondary balun layer 140. In one embodiment, the substrate layer 130 is a thin film of polyimide. However, one of ordinary skill in the art will recognize that other materials may be used to implement layer 130.

Figure 2:
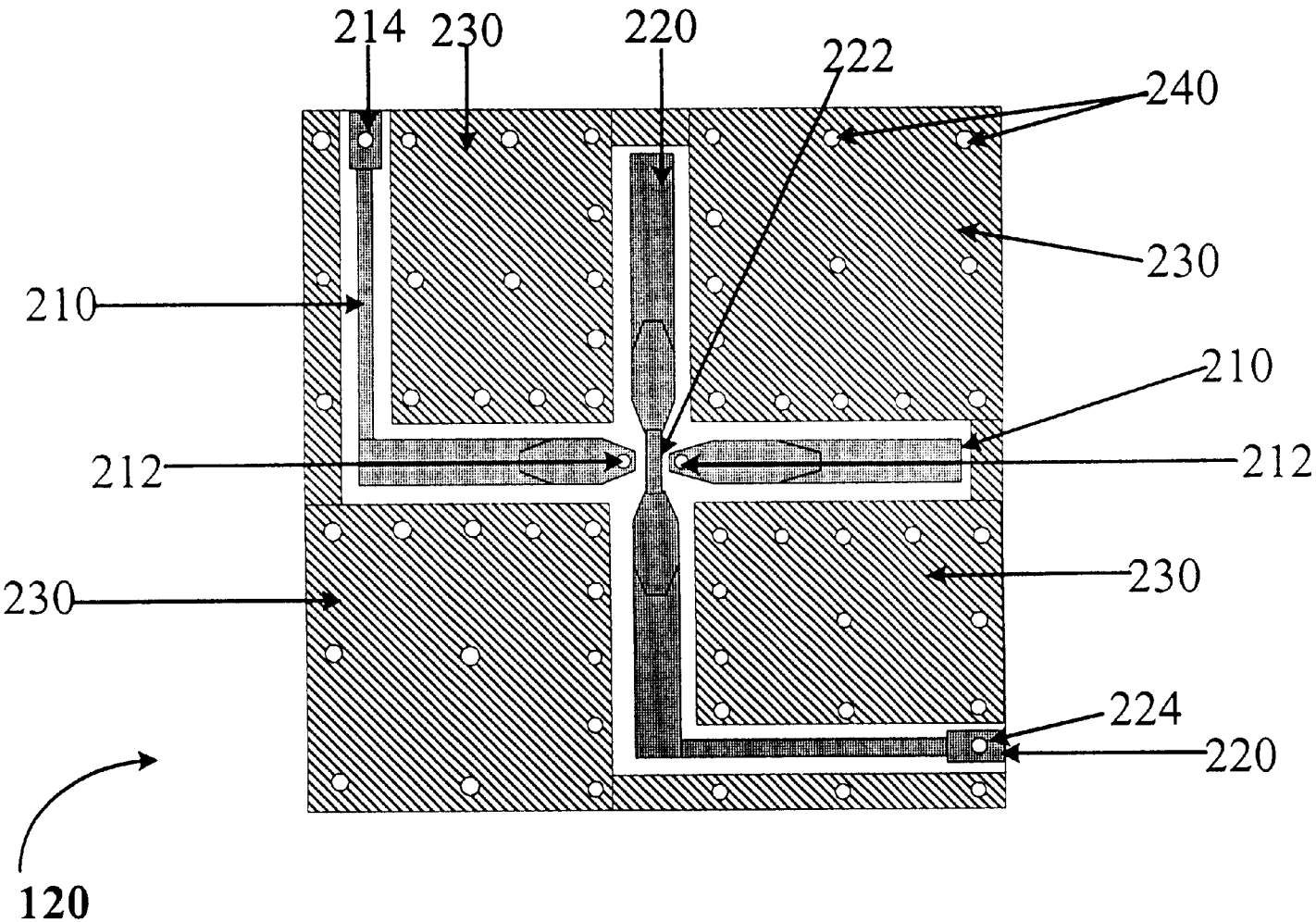
FIG. 2 illustrates one embodiment of a primary balun layer.

Secondary balun layer 140 is a printed circuit layout that includes a second balun component. In one embodiment, the primary and secondary baluns form a modified Marchand balun. FIG. 2 illustrates one embodiment of primary balun layer 120. Balun layer 120 includes balun feed elements 210 and 220. Feed elements 210 and 220 are coupled to RF connector 110 at connectors 214 and 224, respectively. In one embodiment, connectors 214 and 224 are isolated from an orthogonal pit at the center of balun feed elements 210 and 220.

Feed elements 210 and 220 each conducts energy received from a wireless radio device. Feed element 210 includes connectors 212 that couples element 210 to a continuing feed element on secondary balun layer 140. Feed element 220 includes a crossover section 222 that couples two segments of element 220. Primary balun layer 120 also includes a ground 230 that surrounds feed elements 210 and 220. Further, layer 120 includes vias 240 that couple primary balun layer 120 to secondary balun layer 140.

Figure 3:
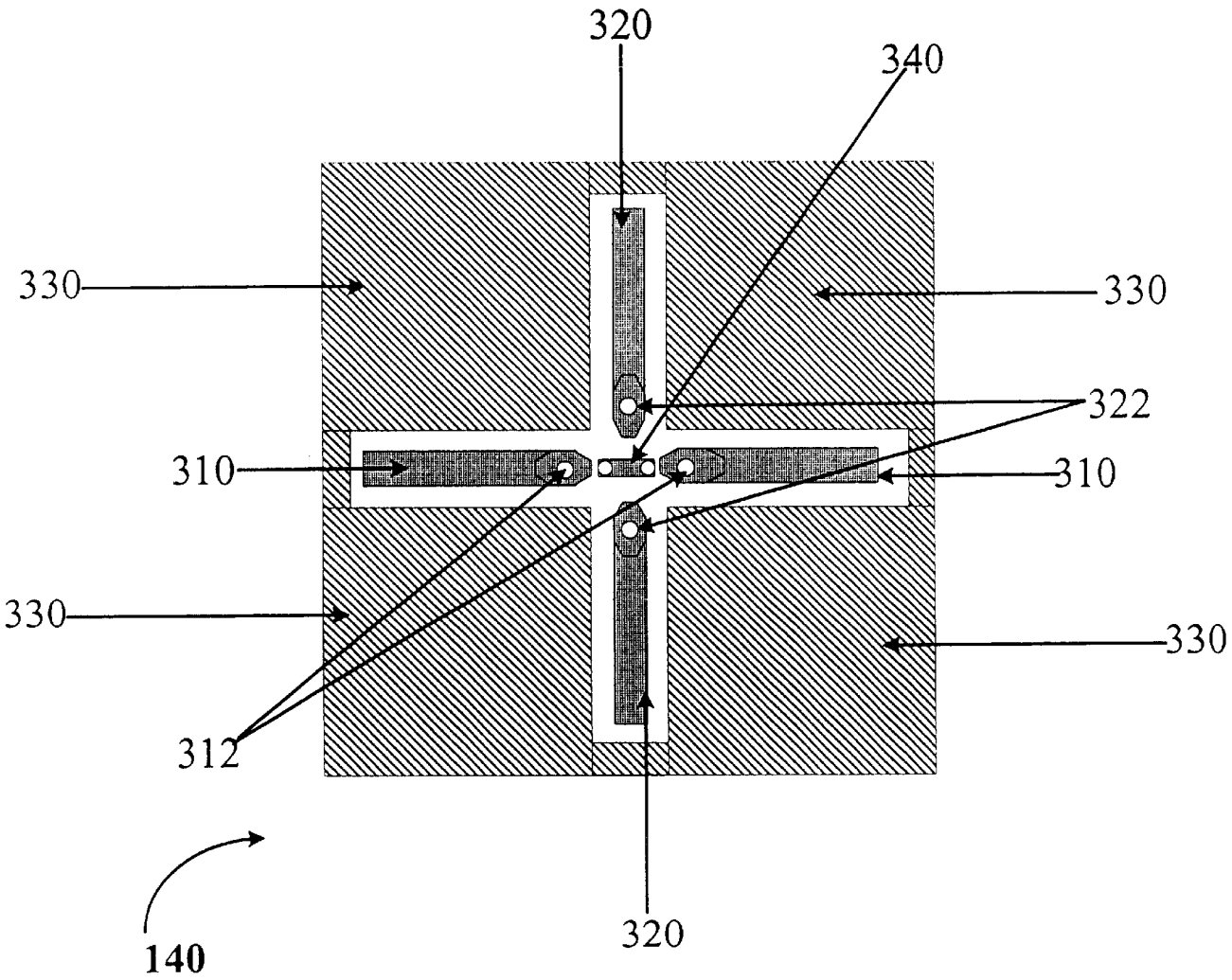
FIG. 3 illustrates one embodiment of a secondary balun layer.

FIG. 3 illustrates one embodiment of secondary balun layer 140. Layer 140 includes feed element 310 and 320. Feed elements 310 and 320 are continuations of feed elements 210 and 220, respectively, illustrated in FIG. 2. Feed elements 310 and 320 each include antenna connectors 312 and 322, respectively, that connect the feed elements to antenna layer 170. In addition, feed element 310 includes a cross-over section 340 that couples two segments of element 310.

Cross-over section 340 is coupled to connectors 212 of feed element 210. In addition, secondary balun layer 140 includes a ground 330 that surrounds feed elements 310 and 320. In one embodiment, layers 120 and 140 are etched copper on FR4 circuit layers. However, in other embodiments, layers 120 and 140 may be implemented using other types of circuit materials on other substrate layers (e.g., G10).

The arrangement of the printed circuit tracks on primary balun layer 120 and secondary balun layer 140 enables the baluns to be orthogonal. The orthogonal configuration facilitates a high degree of isolation throughout the balun feeds and antenna layer 170. As described above, the primary and secondary configuration enables a modified Marchand balun.

The balun configuration described in the figures above result in a low insertion loss over a bandwidth of 1 GHz. When the balun is used to feed antenna layer 170, isolations as high as 40 dB may be achieved.

Referring back to FIG. 1, case 150 is layered above secondary balun layer 140. Case 150 is the covering layer of system 100. Thus, case 150 is a laptop case, or PDA case. RAM 160 is layered over case 150 in order to minimize the reflected energy from case 150. In one embodiment, RAM 160 has an impedance characteristic equivalent to free-space. If RAM 160 were not included, energy from antenna layer 170 would be received at case 150 (e.g., a ground plane). With only case 150, a high percentage of the radiation energy is reflected back and severe loading of antenna layer 170 would occur.

Figure 4:
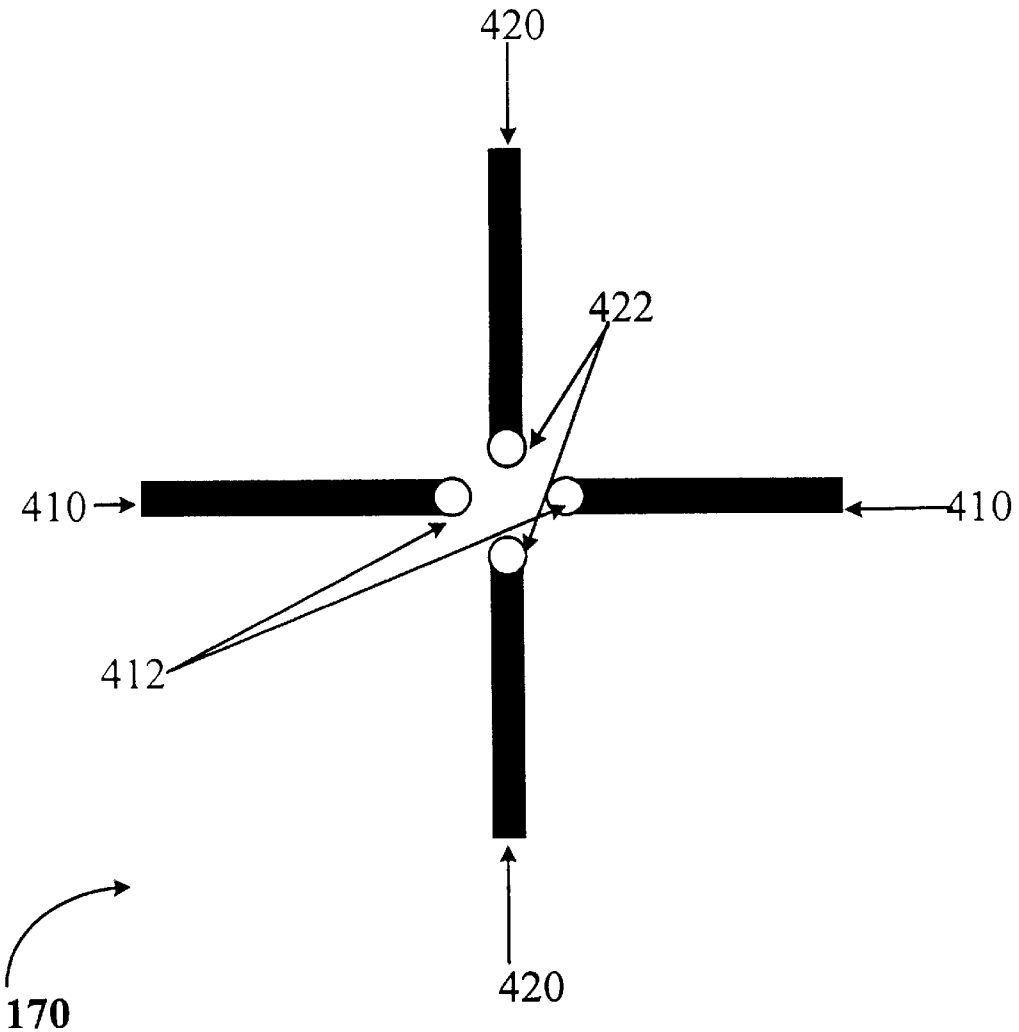
FIG. 4 illustrates one embodiment of an antenna layer.

Antenna layer 170 is layered on case 150 above RAM layer 160. Wire feed through 180 is an opening through antenna layer 170 to secondary balun layer 140 that enables wire feeds to be received at antenna layer 170. FIG. 4 illustrates one embodiment, of antenna layer 170. In one embodiment, antenna layer 170 is printed on RAM 160. The antenna layer includes antennas 410 and 420 arranged in an orthogonal configuration. In one embodiment, antennas 410 and 420 are dipole antennas. Antennas 410 and 420 are arranged orthogonally so that energy that radiates off of one antenna does not couple to the other antenna, and vice versa.

The balun design in combination with the crossed dipole antennas enable overall isolation to be in excess of 30 dB, which reduces the constraints on design of transmitters and receivers for simultaneous radio operation on system 100.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as the invention.

What is claimed is:

1. A system comprising a first dipole antenna;

a second dipole antenna located orthogonal to the first dipole antenna; and a first layer including:

a first balun coupled to the first dipole antenna;

a second balun coupled to the second dipole antenna, the second balun located orthogonal to the first balun; and a ground surrounding the first balun and the second balun.

2. The system of claim 1 further comprising:

a second layer coupled to the first layer.

3. The system of claim 2 wherein the first layer further comprises vias that couple the first layer to the second layer.

4. The system of claim 2 wherein the first balun comprises:

a first component;

a second component; and a cross-over section on the first layer coupled between the first and second components.

5. The system of claim 4 wherein the second balun comprises:

a first component; and a second component, the first and second components of the second balun including connections on the first layer to the second layer.

6. The system of claim 5 wherein the second layer comprises:

the first and second components of the first balun;

the first and second components of the second balun; and a ground surrounding the first balun and the second balun.

7. The system of claim 6 wherein the second balun comprises a cross-over section on the second layer coupled between the first and second components.

8. The system of claim 1 wherein feeds to the first balun and the second balun are isolated from the first dipole antenna and the second dipole antenna.

9. The system of claim 1 wherein the system is a laptop computer.

10. The system of claim 1 wherein the system is a personal digital assistant.

11. The system of claim 1 wherein the first dipole antenna has a greater than 30 decibel (dB) isolation from the second dipole antenna.

12. A system comprising:

a first dipole antenna;

a second dipole antenna located orthogonal to the first dipole antenna; and a cross balance/unbalance (balun) feed coupled to the first dipole antenna and the second dipole antennae;

a first layer;

a second layer coupled to the first layer;

a radio frequency (RF) connection coupled to the first layer;

an isolation layer between the first layer and the second layer;

a system cover layer; and an RF absorbing material covering the system cover layer.

13. The system of claim 12 wherein the isolation layer is a dielectric material.

14. The system of claim 12 further comprising an antenna layer that includes the first antenna and the second dipole antenna.

15. A system comprising:

a system cover layer;

a first dipole antenna printed on the system cover layer;

a second dipole antenna printed on the system cover layer orthogonal to the first dipole antenna; and a first layer including:

a first balun coupled to the first dipole antenna;

a second balun coupled to the second dipole antenna, the second balun located orthogonal to the first balun; and a ground surrounding the first balun and the second balun.

16. The system of claim 15 further comprising:

a second layer coupled to the first layer below the system cover layer.

17. The system of claim 16 wherein the first layer comprises:

the first balun;

the second balun; and a ground surrounding the first balun and the second balun.

18. The system of claim 17 wherein the first layer further comprises vias that couple the first layer to the second layer.

19. The system of claim 17 wherein the first balun comprises:

a first component;

a second component; and a cross-over section on the first layer coupled between the first and second components.

20. The system of claim 19 wherein the second balun comprises:

a first component; and a second component, the first and second components of the second balun including connections on the first layer to the second layer.

21. The system of claim 20 wherein the second layer comprises:

the first and second components of the first balun;

the first and second components of the second balun; and a ground surrounding the first balun and the second balun.

22. The system of claim 21 wherein the second balun comprises a cross-over section on the second layer coupled between the first and second components.

23. The system of claim 15 wherein feeds to the first balun and the second balun are isolated from the first dipole antenna and the second dipole antenna.

24. The system of claim 15 wherein the system is a laptop computer.

25. The system of claim 15 wherein the system is a personal digital assistant.

26. The system of claim 15 wherein the first dipole antenna has a greater than 30 decibel (dB) isolation from the second dipole antenna.

27. A system comprising:

a system cover layer;

an antenna layer printed on the system cover layer;

a cross balance/unbalance (balun) feed coupled to the antenna layer;

a first layer;

a second layer coupled to the first layer;

a radio frequency (RF) connection coupled to the first layer;

an isolation layer between the first layer and the second layer; and an RF absorbing material between the system cover layer and the antenna layer.

28. The system of claim 27 wherein the isolation layer is a dielectric material.

29. A laptop computer comprising:

a cover layer;

an antenna layer printed on the cover layer, the antenna layer comprising:

a first dipole antenna; and a second dipole antenna located orthogonal to the first dipole antenna;

a first layer including:

a first balun coupled to the first dipole antenna;

a second balun coupled to the second dipole antenna, the second balun located orthogonal to the first balun; and a ground surrounding the first balun and the second balun; and a second layer coupled to the first layer below the laptop computer cover layer.

30. The laptop computer of claim 29 wherein the first layer further comprises vias that couple the first layer to the second layer.

31. The laptop computer of claim 29 wherein the first balun comprises:

a first component;

a second component; and a cross-over section on the first layer coupled between the first and second components.

32. The laptop computer of claim 31 wherein the second balun comprises:

a first component; and a second component, the first and second components of the second balun including connections on the first layer to the second layer.

33. The laptop computer of claim 32 wherein the second layer comprises:

the first and second components of the first balun;

the first and second components of the second balun; and a ground surrounding the first balun and the second balun.

34. The laptop computer of claim 33 wherein the second balun comprises a cross-over section on the second layer coupled between the first and second components.

35. The laptop computer of claim 29 wherein feeds to the first balun and the second balun are isolated from the first dipole antenna and the second dipole antenna.

36. A laptop computer comprising:

a cover layer;

an antenna layer printed on the cover layer, the antenna layer comprising:

a first dipole antenna; and a second dipole antenna located orthogonal to the first dipole antenna;

a cross balance/unbalance (balun) feed coupled to the antenna layer;

a radio frequency (RF) connection coupled to the first layer;

an isolation layer between the first layer and the second layer; and an RF absorbing material between the cover layer and the antenna layer.

37. The laptop computer of claim 36 wherein the isolation layer is a dielectric material.

* * * * *